United States Patent [19]

Newbold

[11] 4,037,491

[45] July 26, 1977

[54] SEWING MACHINE FOOT SWITCH OPERATING DEVICE

[76] Inventor: Zebbie J. Newbold, 3512 NW. 14th Terrace, Miami, Fla. 33125

[21] Appl. No.: 688,326

[22] Filed: May 20, 1976

[51] Int. Cl.[2] ..... G05G 1/14; D05B 75/00; H01H 3/14

[52] U.S. Cl. ..... 74/561; 112/275; 200/86.5; 200/153 C

[58] Field of Search ..... 74/561, 560, 514, 564, 74/526, 512; 112/217.3, 217.4, 219 A, 219 R, 218 R; 200/86.5, 153 C, 295, 330; 312/245, 248

[56] References Cited

U.S. PATENT DOCUMENTS

| | | | |
|---|---|---|---|
| 140,677 | 7/1873 | Bushfield | 74/561 |
| 2,803,971 | 8/1957 | Turner | 74/526.3 |
| 2,964,970 | 12/1960 | Hiegel et al. | 112/218 R X |
| 3,103,905 | 9/1963 | Althens et al. | 74/478 X |
| 3,327,662 | 6/1967 | Abate et al. | 112/217.3 |
| 3,521,936 | 7/1970 | Coke | 312/245 X |

*Primary Examiner*—Carlton R. Croyle
*Assistant Examiner*—Richard E. Gluck
*Attorney, Agent, or Firm*—Robert D. Farkas

[57] ABSTRACT

This disclosure pertains to an adjustable semi-stationary sewing machine foot switch operating device accommodating various sized foot switch mechanisms and including an operating treadle having a heel rest and a projection therebelow to activate the foot switch when depressed. A rectangular frame having longitudinal slots and two threaded rods provide an adjustable nest securing the foot switch therewithin. The treadle panel is hingeably affixed to the framework and is biased upwardly forming an acute angle to a lateral horizontal supporting surface.

9 Claims, 3 Drawing Figures

SEWING MACHINE FOOT SWITCH OPERATING DEVICE

BACKGROUND OF THE INVENTION

1. The Field of the Invention

This invention relates to foot switch operating devices and more particularly to that class providing an adjustable nest accomodating variously shaped foot switches.

2. Description of the Prior Art

The prior art abounds with a variety of foot switch operating brackets or foot treadles. U.S. Pat. No. 3,103,905 issued on Sept. 17, 1963 to H.E. Althens et al. teaches a foot treadle operating a foot switch there below. U.S. Pat. No. 3,327,662 issued on June 27, 1967 to P.J. Abate et al. discloses a foot switch operated by a foot treadle which is pivotably fixed to a sewing machine table. All of the aforementioned patents suffer the common deficiency of accomodating only one size foot switch whose housing must be fixedly secured to the foot switch operating mechanism disclosed therewithin.

SUMMARY OF THE INVENTION

A primary object of the present invention is to provide a foot switch operating device which accomodates various size foot switches. Another object of the present invention is to provide a nest, easily adjustable in size over a wide dimensional range.

Still another object of the present invention is to provide a foot switch operating treadle whose weight is biased away from the foot switch thus preventing the inadvertant operation thereof.

Yet another object of the present invention is to provide an operating pedal which can be operated utilizing both feet of the user and including a heel rest therefor.

Foot switches, utilized on sewing machines, are generally small and lightweight in construction. The operator frequently must grope with one foot for the elusive and constantly position changing foot switch. The instant invention includes a nest which retains the foot switch therewithin and is of sufficient weight and size to remain in a given position and location and can be conveniently operated by the user.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a U shaped frame member, for resting on the floor, having a plurality of slots in each of the three bar members. A treadle is hinged along the center member, comprising a plate whose marginal edges substantially conform with the overall dimensions of the three sided frame member. A projection, utilized as heel support, extends upwardly from the uppermost surface of the treadle and is located along the marginal edge thereof that is hingeably secured to the center member of the U shaped frame. A tapered wedge-like bar is secured to the undermost surface of the treadle and is utilized for depressing the foot switch located therebelow when the treadle is depressed.

A fourth bar member is adjustably secured along the length of the two side bar members of the U shaped frame utilizing bolts passing through the longitudinal slots therewithin. A pair of threaded rods pass through slots in the center member of the U shaped frame and slots in the fourth member. The two threaded rods may be located, in parallel relationship to one another, varying distances apart and may be locked into position utilizing locking nuts which engage the outermost surface of the composite frame-like member, thus providing an adjustable nest for the foot switch, having a selected width and length. A rubber-like strip is secured to the uppermost surface of the framework, preferably on the center member of the U shaped frame, providing a bias force, acting on the treadle urging it upwardly and having a moderate magnitude easily overcome when the operator allies a downward force on the treadle utilizing one or both feet therefor.

Figure 1:
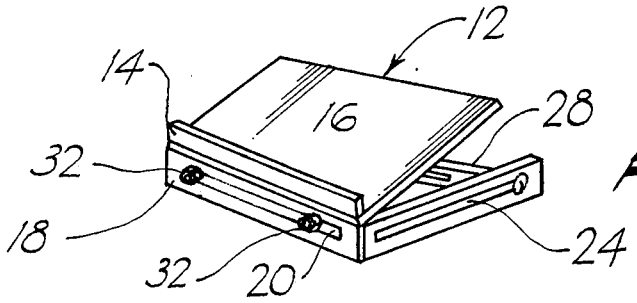
FIG. 1 is a perspective view of the present invention.

Now referring to the figures and more particularly to the embodiment illustrated in FIG. 1 showing the present invention comprising a treadle 12 and a heel rest 14 affixed to the uppermost lateral surface 16 thereof. Treadle 12 is hingeably affixed to bar 18. Slot 20 has threaded rods emerging therefrom. Slot 20 may be unitary or comprise two slots. Slot 24 has screw 26 passing therethrough engaging bar 28.

Figure 2:
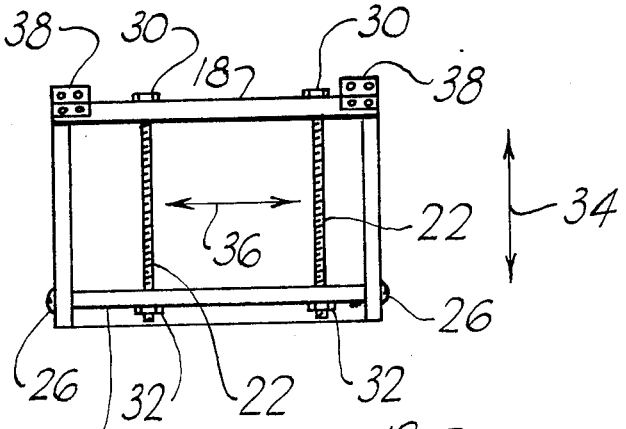
FIG. 2 is a plan view of the present invention with the foot treadle removed.

FIG. 2 shows bar 18 and threaded rods 22 passing therethrough with nuts 30 engaging bar 18. Rods 22 also pass through bar 28 and are in touching engagement therewith utilizing nuts 32 therefor. Bar 28 can move in the direction of arrows 34 when screws 26 are loosened and moved along slot 24, shown in FIG. 1. Rods 22 can move in the direction of arrows 36 when nuts 32 are loosened, permitting the rods to slide along slot 20 shown in FIG. 1 and slots, 50 and 52 shown in bar 28 of FIG. 3, through which rods 22 pass. A void is provided, of adjustable dimension, for the foot switch, not shown, by the opposed surfaces of rods 22 and the opposed surfaces of bars 18 and 28. Hinges 38 are utilized to secure treadle 12 shown in FIG. 1.

Figure 3:
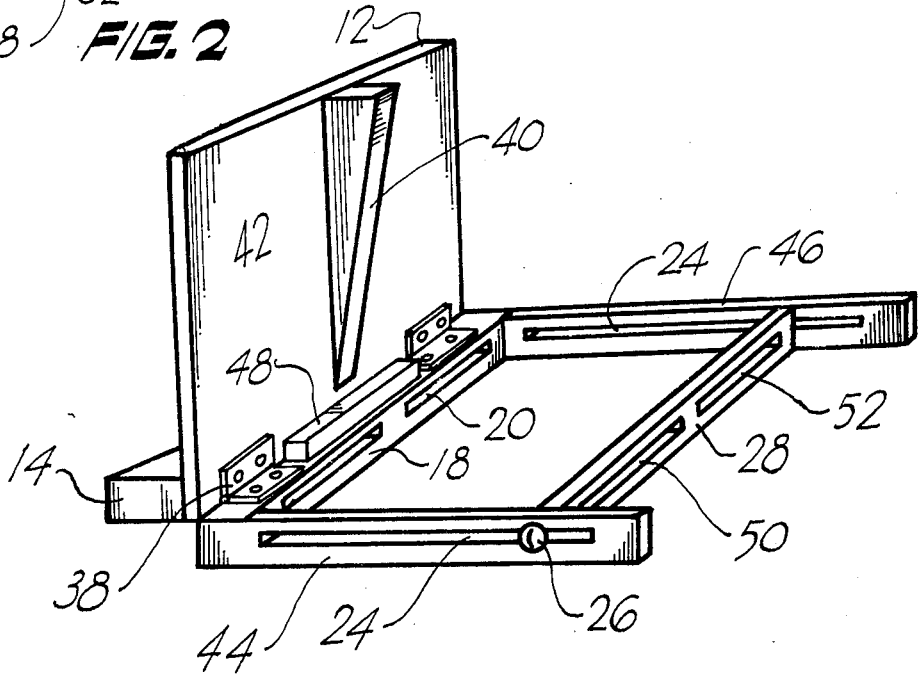
FIG. 3 is a perspective view of the instant invention with the foot treadle shown in the vertical position.

FIG. 3 shows the treadle 12 in the upright position with heel rest 14 extending outwardly therefrom. Tapered wedge 40 is secured to the undermost surface 42 of treadle 12, and is used to operate the foot switch positioned therebelow between bars 18, 28, 44, and 46. Rubber-like member 48 biases treadle 12 upwardly. Rods 22, as shown in FIG. 2, pass through slot 20 and slots 50 and 52. Screws 26 secure bar 28 in a preferred position along the length of bars 44 and 46.

One of the advantages of the present invention is a foot switch operating device which accomodates various size foot switches.

Another advantage of the present invention is a nest easily adjustable in size over a wide dimensional range.

Still another advantage of the present invention is a foot switch operating treadle whose weight is biased away from the foot switch thus preventing the inadvertent operation thereof.

Yet another advantage of the present invention is an operating pedal which can be operated utilizing both feet of the user and including a heel rest therefor.

Thus, there is disclosed in the above description and in the drawings, an embodiment of the invention which fully and effectively accomplishes the objects thereof. However, it will become apparent to those skilled in the art, how to make variations and modifications to the instant invention. Therefore this invention is to be limited, not by the specific disclosure herein, but only by the appending claims.

The embodiment of the invention in which an exclusive privilege or property is claimed are defined as follows:

I claim:

1. A sewing machine foot switch operating device comprising a foot operated treadle, an adjustable four sided rectangular frame, hinging means for hingeably affixing said treadle to said adjustable frame, adjustment means for adjusting the location of one of the sides of said four sided frame, locking means for selectively securing said one of said four sided frame to the two adjacent sides thereto of said four sided frame, an adjustable sized void for the location of a foot switch therewithin, said void contained within a portion of the length of said one side and another side parallel thereto of said four sided frame and a pair of adjustably located rods, said rods parallel to each other and parallel to said two adjacent sides, foot switch operating means for operating a foot switch when said treadle is depressed, heel rest means extending outwardly from said treadle for retention of the heel of the user.

2. The sewing machine foot switch operating device as claimed in claim 1 wherein said hingeing means comprises a pair of hinges hingeably securing said treadle at a marginal edge thereof to said another side of said four sided adjustable frame.

3. The sewing machine foot switch operating device as claimed in claim 1 wherein said adjustment means comprises a slot located in each of said adjacent sides extending substantially along the entire length thereof, a bolt passing through each of said slots, each of said bolts threadingly engaged to an end of said one side.

4. The sewing machine foot switch operating device as claimed in claim 3 wherein said locking means comprises said bolts for locking said ends to said adjacent sides when said bolts are tightened at a selected location along the length of said two adjacent sides.

5. The sewing machine foot switch operating device as claimed in claim 1 wherein said foot switch operating means comprises a wedge-shaped bar fixedly secured to the lowermost lateral surface of said treadle.

6. The sewing machine foot switch operating device as claimed in claim 2 wherein said heel rest means comprises a projection fixedly secured to the uppermost lateral surface of said treadle, said projection extending adjacent to said marginal edge of said treadle.

7. The sewing machine foot switch operating device as claimed in claim 1 further comprising a first longitudinal slot located in said one side, a second longitudinal slot located in said other side, said rods passing through said first and said second longitudinal slots, rod securing means for locking said rods to said one side and said other side in selected locations therealong.

8. The sewing machine foot switch operating device as claimed in claim 1 further comprising a rubber-like compressible member fixedly secured to said other side and in touching engagement with the lowermost surface of said treadle, said rubber-like compressible member exerting a force on said lowermost surface for urging said treadle pivotably upwardly away from said one side of said four sided adjustable frame.

9. The sewing machine foot switch operating device as claimed in claim 1 wherein the marginal edge of said treadle substantially correspond to the outermost marginal edges of said four sided adjustable frame.

* * * * *